United States Patent [19]

Raviv et al.

[11] Patent Number: 4,932,913

[45] Date of Patent: Jun. 12, 1990

[54] CHILD'S SIMULATED VEHICLE CONTROL DEVICE

[76] Inventors: Roni Raviv; Amir Moses, both of 8 Harriman's Keep, Irvington, N.Y. 10533

[21] Appl. No.: 152,932

[22] Filed: Feb. 5, 1988

[51] Int. Cl.[5] ..... A63H 33/00

[52] U.S. Cl. ..... 446/7; 446/404; 446/406; 273/856

[58] Field of Search ..... 273/86 B, 85 G; 434/45, 434/62, 65; 446/7, 26, 27, 28, 136, 143, 265, 404, 406, 411, 454, 455, 460, 468

[56] References Cited

U.S. PATENT DOCUMENTS

| | | | |
|---|---|---|---|
| 3,101,569 | 8/1963 | Giardina | 446/230 |
| 3,120,716 | 2/1964 | Orenstein . | |
| 3,392,485 | 7/1968 | Asano | 446/454 |
| 3,525,175 | 8/1970 | Wolf . | |
| 3,657,457 | 4/1972 | Poynter . | |
| 3,659,375 | 5/1972 | Stubbmann . | |
| 3,715,832 | 5/1972 | Torres . | |
| 3,978,609 | 9/1976 | English . | |
| 4,167,822 | 9/1979 | Weir et al. . | |
| 4,202,130 | 5/1980 | Smith . | |
| 4,208,831 | 6/1980 | Strauss . | |
| 4,221,072 | 9/1980 | Monin . | |
| 4,265,047 | 5/1981 | Meyer et al. . | |
| 4,269,596 | 5/1981 | D'Andrade . | |
| 4,330,127 | 5/1982 | Brand et al. . | |
| 4,373,722 | 2/1983 | Kite et al. | 273/86 R X |
| 4,421,485 | 12/1983 | Geschwender | 446/7 X |
| 4,422,851 | 12/1983 | Hayashigawa et al. | 434/45 |
| 4,531,751 | 7/1985 | Todokoro . | |
| 4,573,936 | 3/1986 | Wolf . | |
| 4,659,313 | 4/1987 | Kuster et al. | 434/45 |
| 4,695,266 | 9/1987 | Hui | 446/460 X |
| 4,793,610 | 12/1988 | Moomaw et al. | 446/7 X |

*Primary Examiner*—Robert A. Hafer
*Assistant Examiner*—Sam Rimell
*Attorney, Agent, or Firm*—Browdy & Neimark

[57] ABSTRACT

A hand held control device for use by a child to simulate directional and speed control of a vehicle, which device includes a wheel for grasping by the hands of a child at opposed parts thereof, a plurality of electrical switches on the device operable to provide signals for predetermined operations of the device, the switches being positioned on the device to be operable by the fingers of a child while the child's hands are engaging the wheel, a housing member, a controller and a sound generating device in the housing member, the controller including a memory storing data representative of sounds created or creatable by the simulated vehicle including sounds simulating the sounds generated when the simulated vehicle is in motion, the sound generating device being coupled to said controller to convert stored data into audio, the finger operated switches providing input signals to the controller to cause the controller to produce sound data to the sound generating device for audio generation.

28 Claims, 8 Drawing Sheets

CHILD'S SIMULATED VEHICLE CONTROL DEVICE

FIELD OF THE INVENTION

This invention relates to a hand held toy steering or control device for use by preschool children, which will simulate control of a vehicle and emulate various vehicle sounds, such as those of an automobile, motorcycle or even an airplane.

BACKGROUND OF THE INVENTION

Children's desire to emulate adults is a basic element in their play. They are especially attracted to the control of vehicles such as automobiles. Accordingly, there are various toys which emulate the control of automobiles, utilizing manipulatable simulated control elements (such as rotatable steering wheel, movable gear shift lever). These toys, which are exemplified in U.S. Pat. Nos. 3,120,716; 3,659,375; and 4,208,831, are shaped as a dashboard console, which is floor or table placed, and in front of which the child sits, while manipulating the controls. Some of these stationary consoles, such as the one disclosed in U.S. Pat. No. 4,265,047, generate sounds typical of an automobile in motion to enhance the illusion of driving an automobile. These sound generating dashboard console toys, due to their shape, size and weight, are not appropriate for play in which the child walks or runs.

A non-sound generating toy, disclosed in U.S. Pat. No. 3,715,832 is designed as a flat simulated dashboard which is supported by the child's body, utilizing a neck strap or other means, and leaving the hands free to engage a steering wheel, gear lever and other controls. This simulated dashboard-shaped apparatus, though portable, would not provide the necessary freedom of motion that would allow a child to run and easily move about while fantasizing various driving situations, specially so for younger, preschool age children. Additionally, it does not provide the sounds of the simulated vehicle. A toy manufactured by Combi, Inc., was comprised of a hand held steering wheel and a separate radio controlled toy car. The motion of the car and the operation of a horn were controlled by the turning of the wheel and by the operation of a switch on the wheel. This toy, however, did not allow for the development of a multitude of imaginary toy driving situations, since attention was focused on maneuvering the radio controlled car.

Most airplane control simulation toys are console based, and stationary. One airplane oriented toy manufactured by Milton-Bradley and named Star-Bird was shaped like an imaginary airplane, and when operated, emitted sounds simulating an airplane. The toy airplane was designed to be held in the child's hand, and emitted a different sound if it was angled upward, horizontally, or at an inclination downward. However, this toy did not provide the child with the illusion that the child was in control of a simulated vehicle.

Few toys simulate motorcycle control units and all that are known are stationary and suffer from the deficiencies previously described.

There is a lack of hand held vehicle control simulation toys available for small children which permit the simulation of control of a simulated vehicle while permitting the child to produce emulation of sounds of operation of the vehicle, and visually closely represent the appearance of the actual device while the child is in motion.

While preschool children wish to emulate parents and other adults, and pretend that they can accomplish adults' tasks and behaviors, the attention span of preschool age children may be short and complicated toys may be quickly discarded and interest lost.

Accordingly, the present invention provides a new easily operable simulated hand held steering or control device adapted to be supported and/or carried by a preschool age child and permit him to simulate and emulate control of the operation of a vehicle, as well as the characteristic operating sounds thereof.

SUMMARY OF THE INVENTION

Devices embodying the invention permit a preschool age child to simulate the driving of a vehicle such as an automobile, motorcycle, or even an airplane. The devices are hand held and configured to simulate an automobile steering wheel, a motorcycle handlebars, and/or the control column of an aircraft. In all cases, the device has opposed or spaced apart hand gripping portions, and immediately adjacent the hand gripping portions are switches operable by the child's fingers or thumbs, which will signal for emulation of sounds created or creatable by a vehicle.

Associated with the simulated control device is circuitry responsive to the switches for emulating sounds for a particular vehicle. In the embodiment of a simulated automobile steering wheel, there is provision for the child to emulate acceleration of an automobile through change of gears to a constant high speed, to sound a horn or siren, to simulate braking of a vehicle with accompanying sound of a screech of rubber tires as the brakes are applied, and also to emulate a squeal if the steering wheel is turned too sharply.

Logic circuitry is provided in a microcontroller to determine timing and continued timing of a routine so that the routine will be continued as long as the child continues to have interest in the device; but will shut down the routine if the child fails to continue an active interest in the device. The microcontroller also has storage of digital data indicative of vehicle sounds, which data is audibly reproduced in a programmed manner in response to input by the child.

There is an initial timing period that governs the time of operation of the device, but if the child continues to show interest and operate the device, the timing period will be reset so that operation continues for the predetermined time period unless it is again reset.

A device embodying the invention provides a child with means for dynamic and realistic vehicle control and allows new play patterns to take place including interaction of the child with the environment, interaction of the child with other children in the operation of the toy, such as taking passengers in the imaginary vehicle, or being stopped by another child who plays the part of a policeman. A device embodying the invention also permits interaction of two or more children, each one having the same toy, as for example, in simulated vehicle races or police chases.

Accordingly, it is an object of this invention to provide a simulated vehicle control game or apparatus that includes sound effected by operator controls through finger operated switches and through body movements.

Another object of this invention is to provide a new and improved hand held, portable, simulated steering or control device for a vehicle for use by a preschool age child, which will emulate vehicle sounds.

A further object of this invention is to provide a toy of the type described, which will remain active so long as the child continues to use it, but will shut down a predetermined time after the child ceases play.

Still a further object of this invention is to provide a hand held simulated steering device for a preschool age child which permits the child to simulate actual control of a vehicle and emulate sounds characteristic of the vehicle.

The features of the invention which are believed to be novel are particularly pointed out and distinctly claimed in the concluding portion of the specification. The invention, however, together with further objects and advantages thereof, may best be appreciated by reference to the following detailed description taken in conjunction with the drawings.

DETAILED DESCRIPTION OF PREFERRED EMBODIMENT OF THE INVENTION

Figure 2:
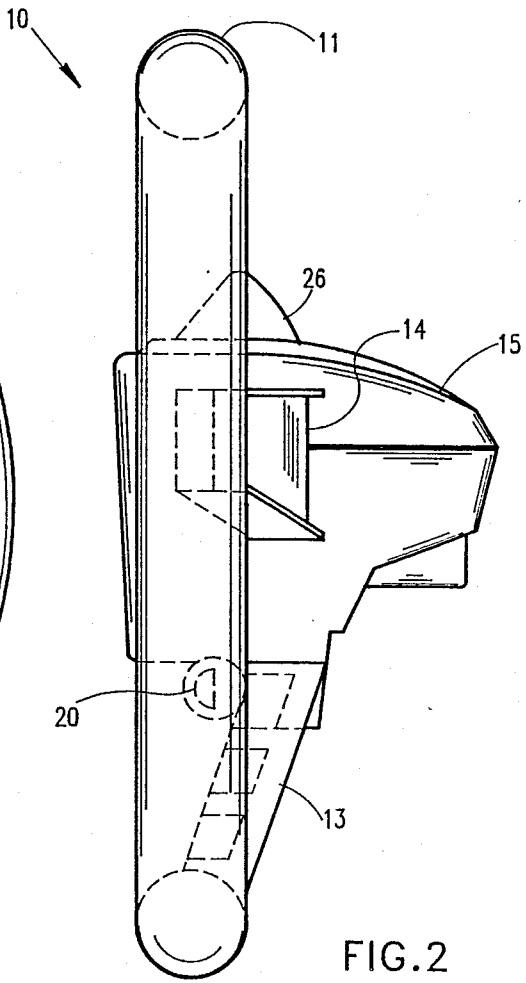
FIG. 2 is a side view of the device of FIG. 1.
Figure 1:
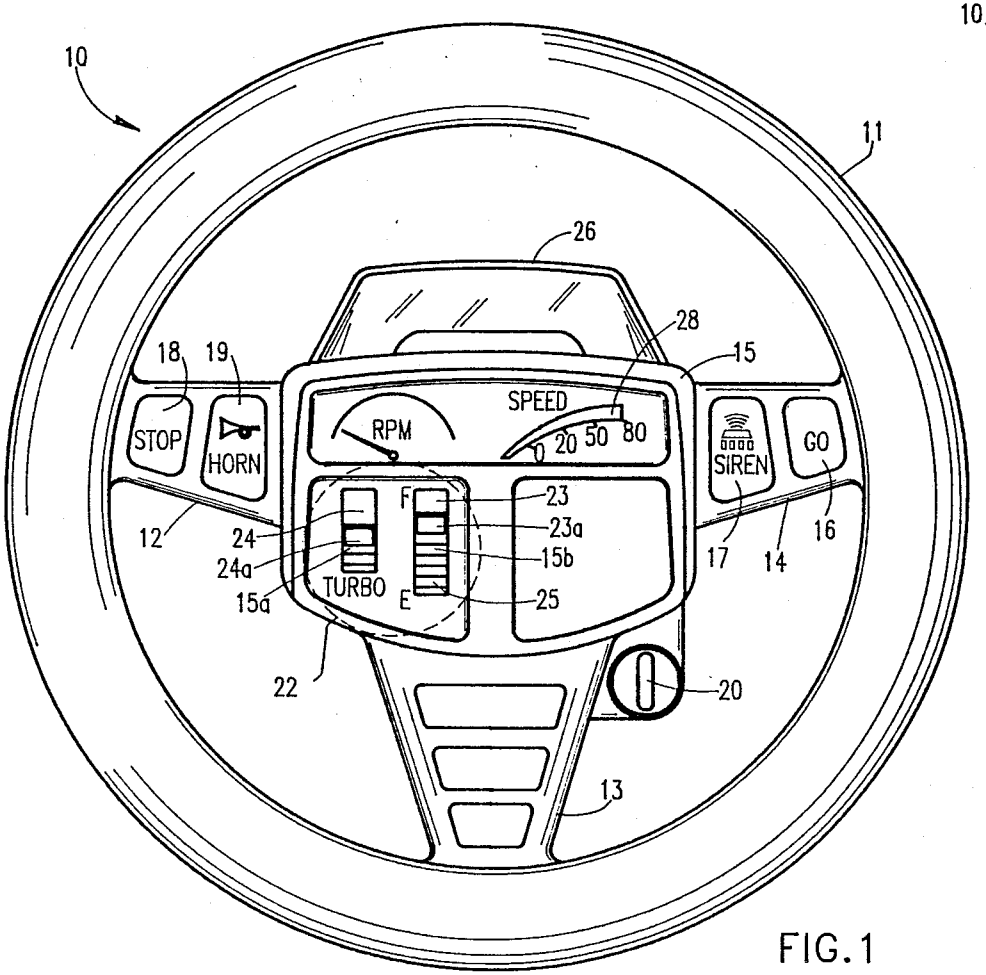
FIG. 1 is a front view of a device in the form of an automobile steering wheel embodying the invention.

As seen in FIGS. 1 and 2, a device 10 embodying the invention is in the form of a steering wheel for an automobile and comprises a rim 11 with spoke members 12, 13 and 14 extending into a central housing portion 15. Mounted in spoke portion 14 are buttons marked GO 16 and SIREN 17, which will actuate switches as hereinafter described. Positioned on spoke 12 is a STOP button 18 and a HORN button 19, which also operate switches as hereinafter described. An OFF-ON simulated key 20 will operate a switch to turn the device OFF and ON. Mounted within housing 15 behind openings 15*a* and 15*b* in housing 15 is a speaker 22 shown only in broken line. Mounted within openings 15*a* and 15*b* are slides 23 and 24, respectively, with finger tabs 23*a* and 24*a* thereon. The slides are movable over a grill 25 over speaker 22 to mute the sound from speaker 22, if desired.

A simulated windshield 26 of clear plastic extends from the top of housing 15. The housing 15 contains the controls for the device, as will hereinafter be described.

Further defined in the front of housing member 15 is an opening 28 behind which is placed a light emitting diode (LED) lamp, which will either flicker or be illuminated under conditions hereinafter described. The opening 28 is preferably covered with a transparent red lens. The LED will flicker at varying rates, depending upon the speed attained, or be constant at highest speed, as will hereinafter be explained. The steering wheel of FIGS. 1 and 2 is arranged to be grasped by the hands of a child at or adjacent to the spokes so that the thumb may operate the adjacent switches.

Figure 3:
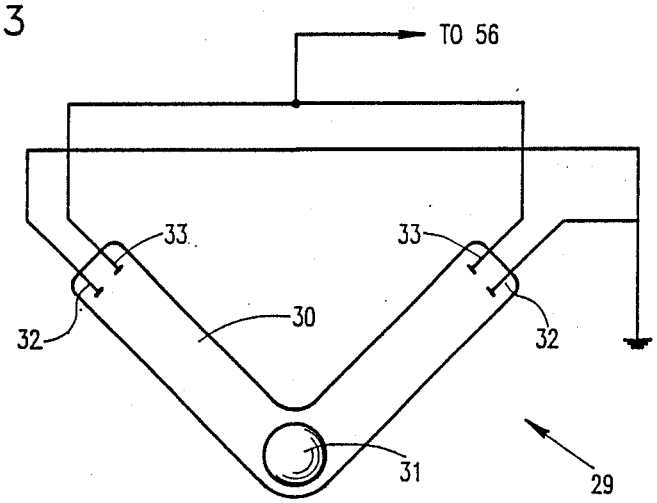
FIG. 3 is a representation of a position sensing switch utilized in the invention.

Reference is now made to FIG. 3 which exemplifies a position sensing switch 29 which comprises a generally V-shaped insulated housing member 30 with a conductive ball 31, or a ball having a conductive coating thereon. At either end of the housing 30 are a pair of terminals 32 and 33, which will be closed when contacted by the ball. Switch 29 is mounted in housing 15 and will sense when the wheel is turned a predetermined amount in either direction.

Figure 4:
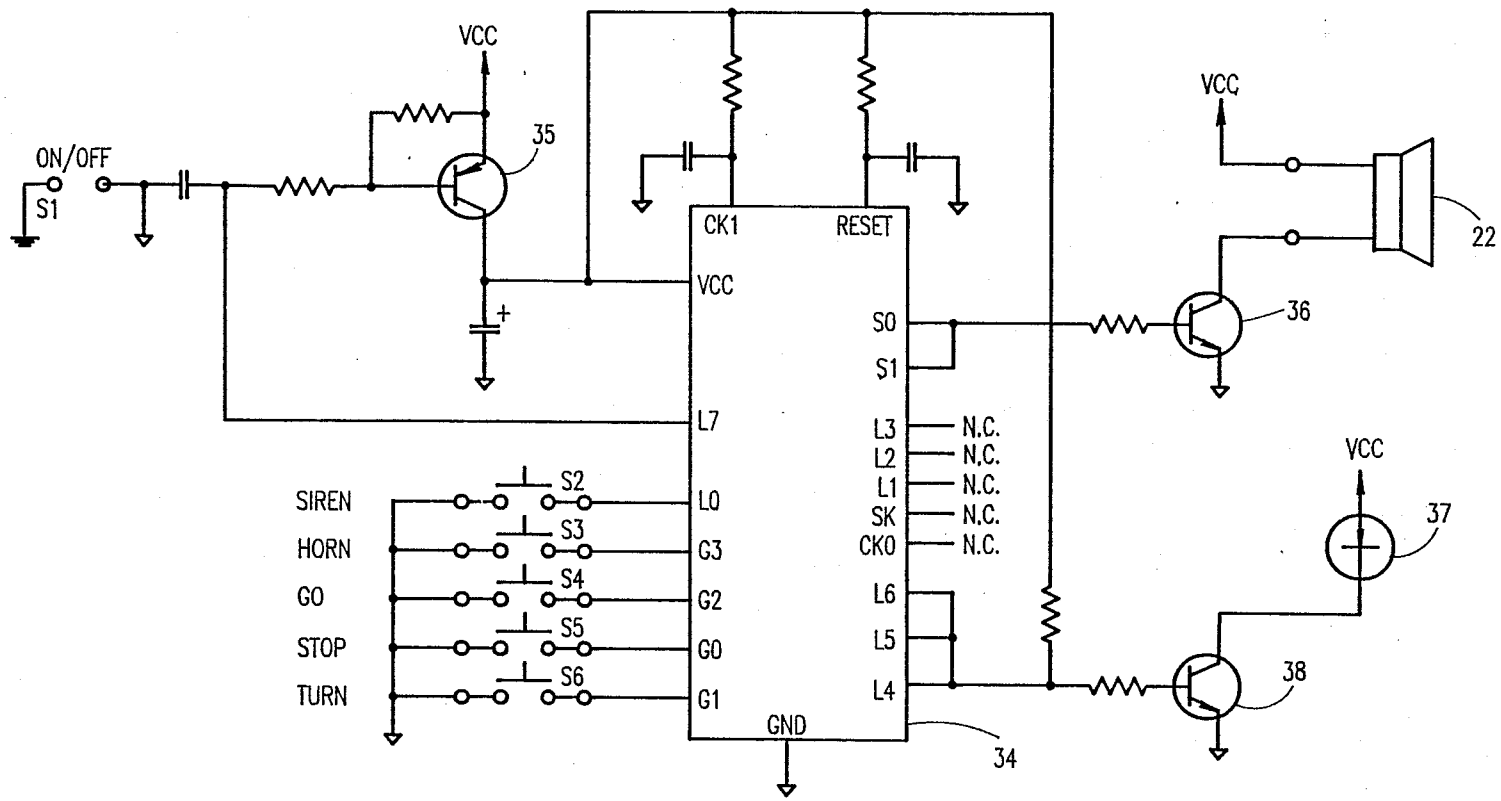
FIG. 4 is a schematic diagram of electronics utilized in the invention.

Reference is now made to FIG. 4 which is a schematic diagram of the electronic system of the invention. The system utilizes a microcontroller 34 designated COP413L of National Semiconductor Corporation of Santa Clara, Calif., which is capable of emulating sound. This microcontroller is hereinafter described. This microcontroller receives power VCC via a transistor 35. When the simulated key 20 is turned, switch S1 is closed. This will pulse the base of transistor 35 which will turn ON. When transistor 35 turns on, it connects the VCC input of microcontroller 34 to an external source of power. Power is also applied to input CK1, which is a system oscillator input and RESET, which is a system reset input. As shown, the reset input is used and connected to VCC to initialize the microcontroller.

The microcontroller receives five inputs, determined by the child operating the toy. These inputs are designated by the switches S2–S6. When button 17 is depressed, switch S2 will close and provide a ground input to a bi-directional input/output (I/O) port LO. When HORN button 19 is depressed, this will close switch S3 and connect port G3 to ground and the microcontroller will generate the sound of a horn except as hereinafter described. When the GO button 16 is depressed, switch S4 will close and this will initiate a sequence of sounds, as will hereinafter be described. When the STOP button 18 is depressed, it will close switch S5, which will cause the microcontroller to generate a sound of braking of a vehicle, namely, a screeching of tires. If the child should turn the wheel too far under certain conditions, a position sensing switch shown in FIG. 3 and S6 will provide an input to input port G1 and the microcontroller will generate a tire squealing sound emulating a sharp turn.

Two outputs are utilized from the microprocessor. One output is from output port SO to the base of a transistor 36 in circuit with speaker 22. The output is from a serial shift register which is clocked at various rates to produce emulation of various sounds; the other output is different frequency pulse ports L4, L5, and L6, to a transistor 38 in series with a LED 37 which is behind the lens covered opening 28 in housing 15, to illuminate LED at different rates.

A system embodying the invention will emulate the following sounds as embodied in the steering wheel of FIGS. 1 and 2.

| SOUND | |
|---|---|
| A | The sound of an engine starting |
| B | Engine revving sound (preferably three cycles) |
| C | Engine idling sound |
| D,E,F | Engine accelerating through a series of gears (3) |
| G | Constant high speed |
| F,E,D | Engine decelerating through a series of gears (3) |
| I | Screech of tires when braking |

-continued

| SOUND | |
|---|---|
| J | Squeal of tires when turning at high speed |
| K | Horn |
| L | Siren |

If desired, sounds A and B may be combined into one sound. Initially, when switch S1 is closed, sounds A, B, and C will be serially heard. If the child presses the GO button, sounds D, E, and F will be heard until top speed is reached when the sound becomes constant, so long as the GO button is depressed. When the GO button is released, the sound will return to the next lowest gear, sound F, then E, then D and finally to idle C. If there is no further activity, the routine will shut down after a predetermined time unless an activity takes place which will reset a routine timer.

Figure 5A:
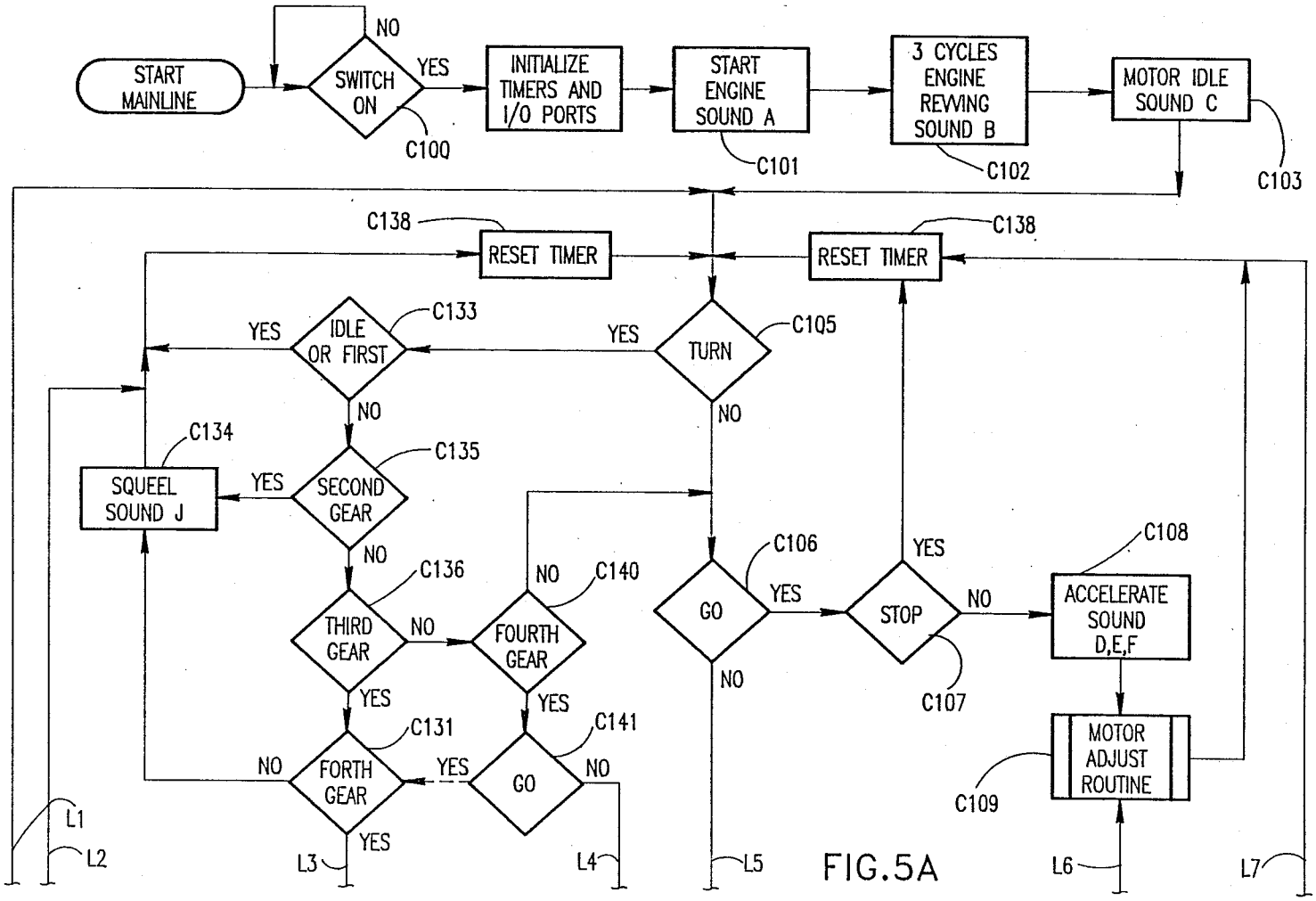
FIGS. 5*a* and 5*b* are a composite flow chart of a routine utilized in the invention, FIG. 5*b* being a continuation of FIG. 5*a;*
Figure 5B:
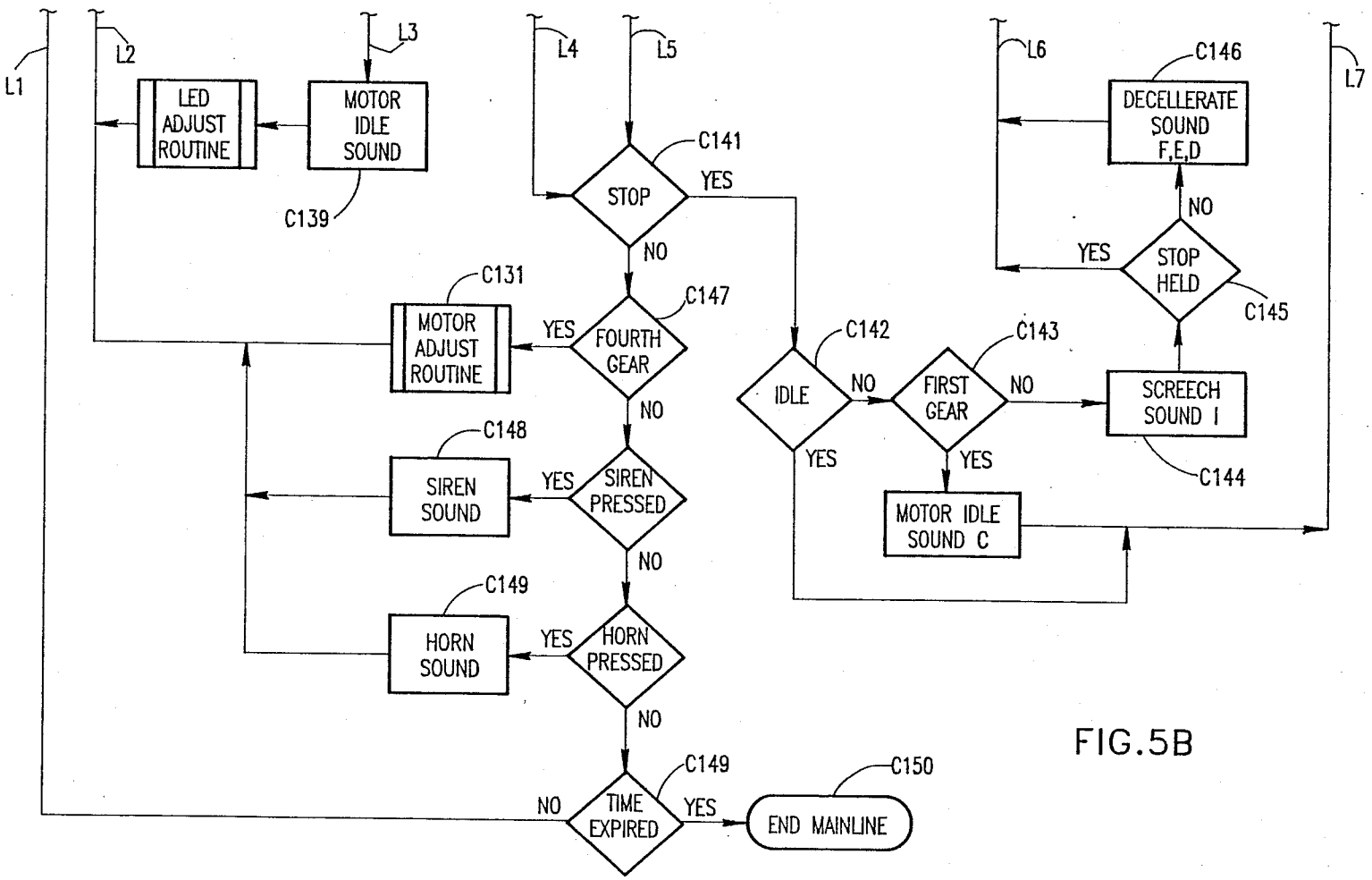

Reference is now made to FIG. 5 for explanation of a routine in accordance with the invention. FIGS. 5*a* and 5*b* provide a functional flow diagram which is illustrative of the programming of microcontroller 34 and the logical sequence of events. In the flow diagram of FIGS. 5*a* and 5*b* and also those of FIGS. 6 and 7, the rectangular blocks represent a set happening, while the diamonds represent a sensed logic condition having an alternative. Sub-routines are indicated by double side lines and exemplified in FIGS. 6 and 7. Ovals represent initiation of a routine or sub-routine and also terms. The general routine is referred to as Mainline. The blocks are identified by the reference C followed by an arabic numeral.

In the organization of the invention, there is a routine timer which may be in the form of a down counter, as hereinafter explained. This timer will be reset for a predetermined time commencing with the idle condition upon the occurrence of an input from any of switches 52–56, FIG. 4.

To initiate operation, key 20 is turned. This closes switch S1 C100 and initializes microcontroller 34 to start condition C101, then at conditon C101, an engine start sound is emulated, and at C102 there is an engine revving emulation followed by an engine idle emulation C103.

Figure 6:
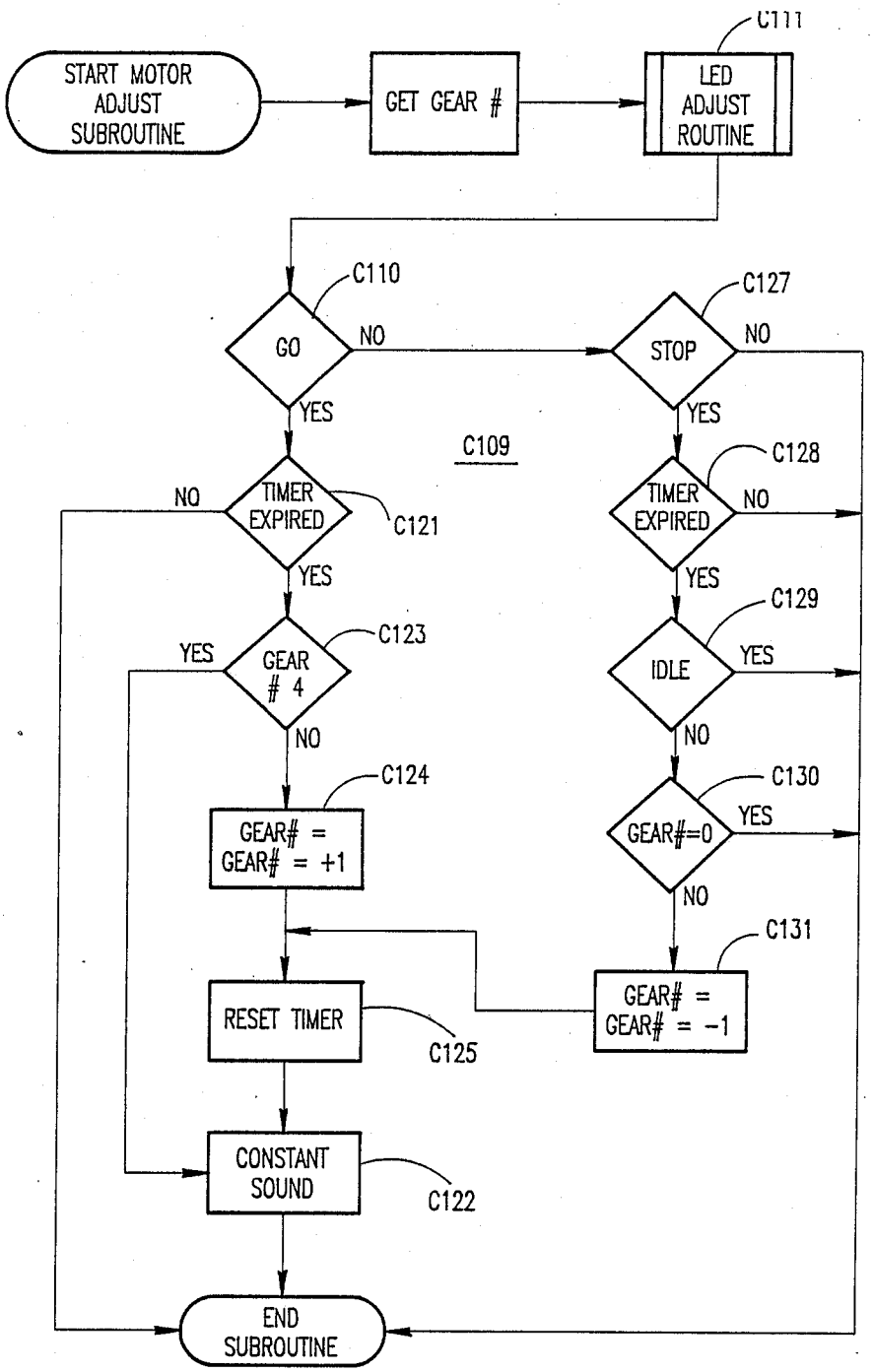

At this time, if there is no turning of the steering wheel 10 at C105, which would close switch S6, and the GO button is depressed C106, switch S4 closed, and there is no pushing of the STOP button C107, an acceleration sound is emulated at C108 and the routine goes into the Motor Adjust Sub-routine C109, which is exemplified in FIG. 6.

When the sub-routine C109 is initiated and GO button is held down and switch S4 kept closed, the microcontroller will cause to be emulated the sound of four gear shifts, from idle to fourth gear. In fourth gear, the engine emulation sound will be constant, sound G.

Figure 7:
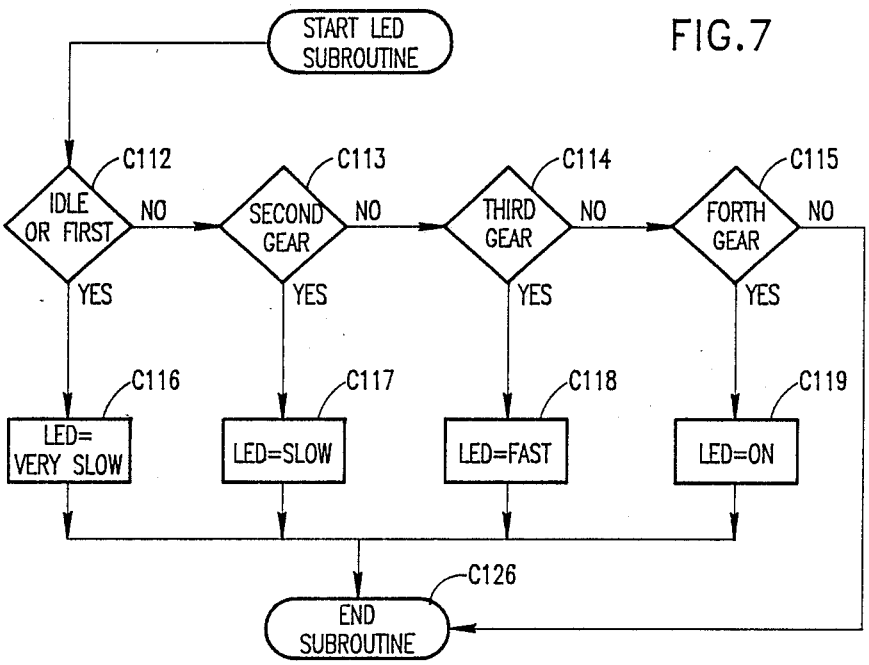
FIGS. 6 and 7 are functional flow charts of sub-routines utilized in the invention.

During sub-routine C109, as GO button 16 is held down and switch S4 is closed at condition C110, and the sound commences to accelerate through the gears at C110, another sub-routine C111 is initiated, as shown in FIG. 7. In idle or first gear C112, the LED blinks very slowly But if the GO button is continued to be depressed with switch S4 closed, condition C112 will advance to conditions C113, C114, and C115, and LED 34 will blink at continuously faster rates, as exemplified at C116, C117, C118, and C119, so long as GO button 14 and switch S4 are held depressed.

Returning to FIG. 6, when the GO button is depressed C110, and a predetermined time has expired C121, if the sound is gear four, the sound will become constant C122. If the gear is not gear four C123, the sound will be upwardly incremented as shown at C124, and a timer is reset C125 to extend the duration of the constant sound at C122. If the GO button is continued to be depressed, the high speed sound will continue for a predetermined time, and then the sub-routine will end C126.

If, at condition C127, the GO button is released and the STOP button 18 is depressed, after a predetermined time C128, the sound may fall to Idle C129, and then after a predetermined time, the sub-routine will end. However, if after condition C128 if there is no Idle and the gear number is not gear C130, the sound will be to decrement the gear sound from high to low at C131. This will reset the timer C125 and the last gear sound will continue until the sub-routine times out. If at C127 the STOP button is not depressed, the sub-routine will time out.

Referring back to FIGS. 5*a* and 5*b*, if the wheel is turned at C105 to close switch S6 and the condition C133 is idle or first gear, there will be no squealing sound. The squealing sound C134 will be generated only in second gear or higher, C135, C136, provided the routine time C137 has not expired. Whenever the squeal sound is generated, the routine timer is reset C138. If the routine time has expired C137, the motor idle sound C139 will be heard and the LED Adjust Routine will cause LED 34 to flicker at the very slow rate.

If at condition C136 the gear is gear number four, C140, and GO button 16 is depressed, C141, and the time has not expired at C137, the squeal sound will be generated and the routine timer C138 will be reset to continue the routine.

FIG. 5*b* is a continuation of FIG. 5*a* and connecting lines are labeled accordingly.

If, at condition C107, the STOP button 18 is depressed, C141, and the sound is not engine idle C142, or first gear C143, a screeching sound emulating the heavy application of brakes will be heard at C144. If the STOP button continues to be held at C145, the routine will go back to the Motor Adjust Sub-routine C109 at condition C127 (FIG. 6). If the STOP button is not held down at C145, there will be a deceleration sound at C146 and the routine will go back to the Motor Adjust Sub-routine at condition C131 (FIG. 6).

Returning to condition C141, if the STOP button is not depressed and the gear number is four C147, the routine goes back to the Motor Adjust Sub-routine C109 at C131 to decrement the gear number. If the gear number is not four, the HORN button (switch S3) or the SIREN button (switch S2) may be depressed to emulate a horn sound or a siren sound C148, and C149.

If a routine is commenced by turning key 20 (switch S1) and the engine sound advances to Idle C103, and no acceleration is made by depressing GO button 14, then after the predetermined time C149, the Mainline routine will end as exemplified at C150. As may be seen from the foregoing description and flow diagrams, the STOP button and switch are not operable when the motor is in IDLE. Additionally, the tire squealing switch has no effect at IDLE. The HORN and SIREN will function after sound C.

Figure 8:
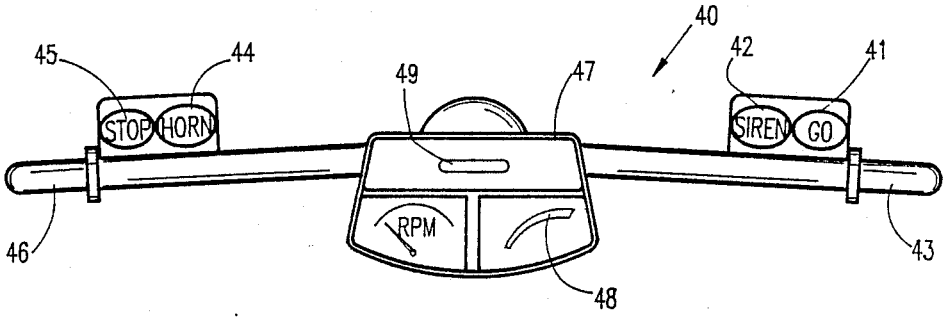
FIG. 8 is a front view of a simulated motorcycle handlebar embodying the invention.

FIG. 8 exemplifies another embodiment of the invention where the steering control device is the steering handlebars 40 of a motorcycle. The device 40 has the same control devices as the steering wheel of FIGS. 1 and 2. A GO button 41 and a SIREN button 42 are located on the right handle grip 43. The STOP and HORN buttons 45 and 44, respectively, are located on the left handle grip 46. The handle bars converge from the hand grip portions 43 and 46, respectively, to a central housing member 47 which includes the speaker, not shown, a window 48 for LED 37, and a key switch 49, the same as key switch 20 of FIGS. 1 and 2. In both embodiments, the RPM indicators are only printed static representation of an RPM gauge. The circuitry and programming for the device of FIG. 8 are the same as that described for the embodiments of FIGS. 1 and 2. The housing 47 will also contain a position sensing switch, as shown in FIG. 3, which will operate a switch S6, as shown in FIG. 4.

Figure 9:
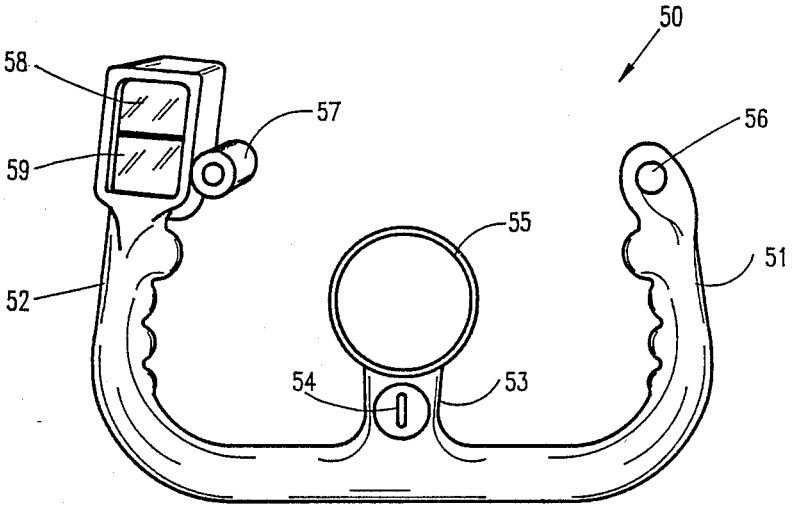
FIG. 9 is a front view of a simulated aircraft control wheel embodying the invention.

FIG. 9 exemplifies the invention embodied in the control wheel 50 of an airplane. The control 50 comprises two opposed hand gripping portions 51 and 52 which may be formed for finger grips. Both of hand gripping positions 51 and 52 extend into a central portion 53 which has an ON-OFF switch 54 and a housing member 55, which includes a speaker, and the microcontroller, neither shown. Positioned just above hand gripping portion 51 is a first switch button 56 for use by a finger of the right hand to produce sounds of acceleration. When the key switch 54 is first turned ON, the microcontroller will produce sounds of airplane engines turning ON at start, then sounds of taxi-ing, then the whine of the engines, either piston or jet, as they are revved up for take-off, then the child depresses button 56 to produce the sounds of take-off of an aircraft. An LED is mounted behind a lens in a partially circular housing portion 57. Two switch operating buttons 58 and 59 are mounted in a housing 60 above left hand gripping portion 52. One is to provide sounds of deceleration such as landing gear being lowered and the sound when the landing flaps are being lowered, and the engines cut back for landing. The other button produces the sound of weapons release, such as a machine gun or the release of rockets. The device 50 further includes a position sensing switch, such as shown in FIG. 3, to determine the attitude of the plane as well as the turn sensing switch, as shown in FIG. 3. If the device of FIG. 9 is tilted downwardly as to simulate a dive or descent, one pair of contacts of the first switch will close and signal to the microcontroller to produce a stored emulation of a higher pitched whine to indicate a dive. If the device is tilted upwardly, the other pair of contacts are closed to signal the microcontroller to produce a sound of climbing which would be a deeper pitch indicative of a greater load on aircraft engines. The second switch when closed on either pair of contacts will produce a "whooshing" sound simulating the sharp banking of an aircraft.

Devices embodying the invention may take many forms, depending on the type of vehicle over which it is desired to simulate control.

Figure 10:
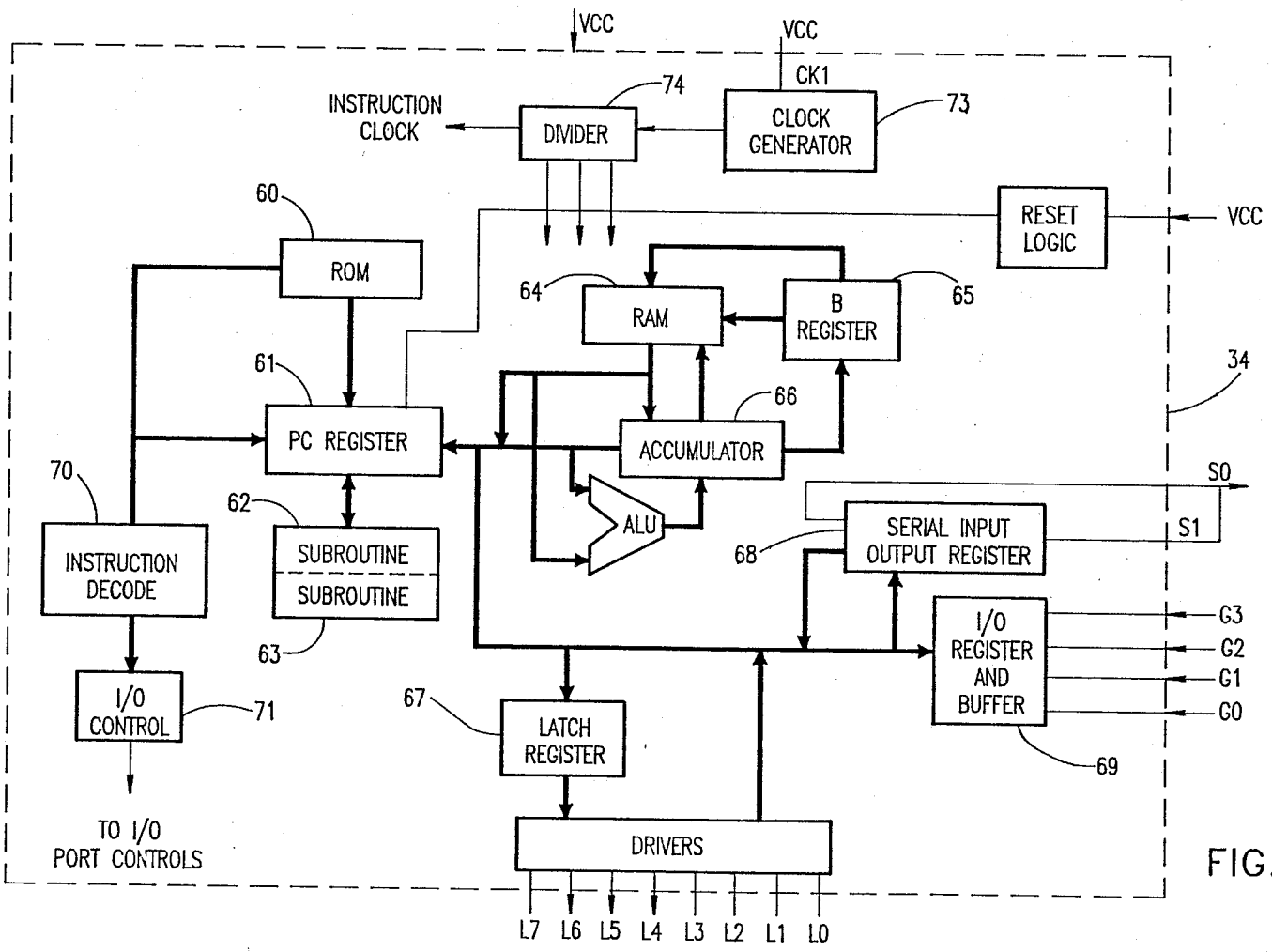
FIG. 10 is a block diagram of a microcontroller utilized in practicing the invention.

A block diagram of microcontroller 34 is set forth in FIG. 10. A read only memory ROM 60 provides the program memory which may contain 512 bytes. These words may be program instructions, program data, or ROM addressing data as well as digital data indicative of sounds.

ROM addressing is accomplished through a program control (PC) Register 61. Its binary value selects one of the word bytes, and a new address is loaded into PC register 61 during each instruction cycle. Two levels of sub-routine resting are provided by sub-routine save registers 62 and 63.

A random access memory (RAM) 64 stores data derived from ROM. RAM addressing is implemented by a B register 65. A RAM word is usually loaded into or exchanged with the accumulator register 66. The accumulator register 66 is the source and destination register for most input/output, arithematic, logic and data memory operations. It may also be used to load portions of B register 65 and a latch register 67, and to perform data exchange with a Serial Input/Output Register (SIO) 68.

Also included is an input/output (I/O) Register and Buffer 69 which receive in the present invention inputs from switches S3–S6. Latch register 67 communicates with four input/output drivers for ports L4–L7.

The latch register 67 is used to hold data from accumulator register 66 and from ROM and RAM. An instruction decode register 70 outputs to an Input/Output Control Register 71. SIO register is configured as a serial shift register and outputs binary words data representative of sound. It is loaded from accumulator register 66 over the system bus. The data is clocked out at different rates, dependent on the sound and the pitch of the sound emulated. The system bus is shown in heavy dark line. The microcontroller 34 also includes an Arithmatic Logic Unit 75 which performs arithmatic and logic functions of microcontroller 34.

A clock generator 73 is provided to provide system timing, and a divider 74 coupled thereto provides selected frequency timing or clocking signals. The pulses for various repetition rates of flashing of LED 37 are taken from I/O ports L4–L6 as shown in FIG. 4. The digital sound data is clocked out of register 69 at frequencies of 100 HZ to 2 KHZ. The clocking signals may be derived from the various outputs of divider 74.

The routine timer may be established as a down counter in accumulator 66 with numbers taken from RAM 64. In practice, the routine timer will time a routine period of two minutes, but may be repeatedly reset for a same additional period upon occurrence of any of the inputs previously discussed. Thus, the device will continue to operate so long as there are input signals indicating the device is being played with.

It may thus be seen that the objects of the invention set forth, as well as those made apparent from the foregoing description, are efficiently attained. While preferred embodiments of the invention have been set forth for purposes of disclosure, modifications to the disclosed embodiments of the invention, as well as other embodiments thereof, may occur to those skilled in the art. Accordingly, the appended claims are intended to cover all embodiments of the invention and modifications to the disclosed embodiments which do not depart form the spirit and scope of the invention.

Having thus described the invention, what is claimed is:

1. A hand held control device for use by a child to simulate directional and speed control of a vehicle, said device including:

a housing member, a controller in said housing member, a sound generating device in said housing member, said controller including memory means storing data representative of sounds created or creatable by the simulated vehicle including sounds simulating the sounds generated when the simulated vehicle is in motion.

said sound generating device being coupled to said controller to convert stored data into audio, and means for sensing angular motion of said device beyond a predetermined angle, and signaling said controller to generate sound typical of dramatic change of lateral direction in the simulated vehicle.

2. The device of claim 1 further including means for grasping by the hands of a child at opposed parts thereof, a plurality of electrical switches on said device operable to provide signals for predetermined operations on said device, said switches being positioned on said device to be operable by the fingers of a child while the child's hands are engaging said grasping means, said switches providing input signals to said controller to cause said controller to produce sound data to said sound generating device for audio generation.

3. The device of claim 1 where the sounds generated include acceleration of the simulated vehicle.

4. The device of claim 1 where the sounds generated include deceleration.

5. The device of claim 2 where the generated sound includes that of squealing tires simulating a sharp turn of the simulated vehicle.

6. The device of claim 1 where the sounds generated include the simulated screeching of tires simulating braking of the simulated vehicle.

7. The device of claim 1 which is in the form of an automobile steering wheel having a rim and spokes connecting said rim to said housing member, which is substantially centrally disposed within the said rim, said switches being positioned on said spokes.

8. The device of claim 1 which is in the form of a motorcycle handlebar having hand gripping portions at either end, and at least one switch on said handlebar adjacent each gripping portion.

9. The device of claim 1 which is in the form of an aircraft control wheel, and at least one switch adjacent each hand gripping portion of said control wheel.

10. The device of claim 9 further including means for sensing change of attitude of said control wheel beyond a predetermined angle, and signaling said controller to generate sound indicative of said change of attitude, simulating the change of engine sound of an aircraft experiencing such change of attitude.

11. The device of claim 8 further including means for sensing angular motion of said handlebar beyond a predetermined angle, and signaling said controller to generate sound typical of dramatic change of lateral direction in the simulated motorcycle.

12. The device of claim 9 further including means for sensing angular motion of said device beyond a predetermined angle and signaling said controller to generate sound typical of dramatic change of direction in the simulated aircraft.

13. A hand held control device for use by a child to simulate directional and speed control of a vehicle, said device including:

means for grasping by the hands of a child at opposed parts thereof, a plurality of electrical switches on said device operable to provide signals for predetermined operations on said device, said switches being positioned on said device to be operable by the fingers of a child while the child's hands are engaging said grasping means, said device including a housing member, a microcontroller in said housing member, an audio speaker in said housing member, said microcontroller including memory means storing digital data representative of sounds created or creatable by the vehicle including the sounds of acceleration and deceleration, and sounds representative of speed of the vehicle, said speaker being coupled to said microcontroller to convert stored digital data into audio, a first of said switches providing an input to said microcontroller to elicit from said memory digital data representative of sounds of acceleration of the vehicle for audio reproduction, a second of said switches providing an input to said microcontroller to elicit from said memory digital data representative of sounds of deceleration of the vehicle for audio reproduction, and means for sensing angular motion of said device beyond a predetermined angle, and signaling said controller to generate sound typical of dramatic change of lateral direction in the simulated vehicle.

14. The device of claim 13, where the device is in the form of an automobile steering wheel having a rim and spokes connecting said rim to said housing member which is substantially centrally disposed within said rim, said switches being positioned on said spokes.

15. The device of claim 14, where a first switch, upon closing thereof, produces an acceleration sound for a predetermined time, as long as it is depressed, and a sound representative of speed attained.

16. The device of claim 15, where a second switch, upon closing thereof, produces a braking sound.

17. The device of claim 16, where depression of said second switch causes the speed sound created by said first switch to decrease in representation of speed.

18. The device of claim 14 further including a switch in said device which will sense predetermined rotation of said wheel and cause said microcontroller to emulate the sound of squealing tires, simulating a turning automobile or motorcycle at high speed.

19. The device of claim 13 where the device is in the form of a motorcycle handlebar having hand gripping portions at either end and at least one switch on said handlebar adjacent each gripping portion.

20. The device of claim 13 where the device is in the form of an aircraft control wheel.

21. A hand held control device for use by a child to simulate directional and speed control of a vehicle, said device including:

means for grasping by the hands of a child at opposed parts thereof, a plurality of electrical switches on said device operable to provide signals for predetermined operations on said device, said switches being positioned on said device to be operable by the fingers of a child while the child's hands are engaging said grasping means, said device including a housing member, a microcontroller in said housing member, a sound generating device in said housing member, said microcontroller including memory means storing digital data representative of sounds created or creatable by the vehicle including the sounds of acceleration and deceleration, and sounds representative of speed of the vehicle, said sound generating device being coupled to said microcontroller to convert stored digital data into audio, said switches providing input signals to said microcontroller to elicit from said memory digital data representative of sounds created or creatable by said vehicle and transfer said digital data to said sound generating device or audio reproduction, said memory storing a program of digital data representative of start-up sounds of the engine of said simulated vehicle, an ON-OFF switch for initializing said program, said switches thereafter upon actuation determining the sounds elicited from said memory and means for sensing angular motion of said device beyond a predetermined angle, and signaling said controller to generate sound typical of dramatic change of lateral direction in the simulate vehicle.

22. The device of claim 21, where the device is in the form of an automobile steering wheel having a rim and spokes connecting said rim to said housing member which is substantially centrally disposed within said rim, said switches being positioned on said spokes.

23. The device of claim 22, where a first switch, upon closing thereof, produces an acceleration sound for a predetermined time, as long as it is depressed, and a sound representative of speed attained.

24. The device of claim 23, where a second switch, upon closing thereof, produces a braking sound.

25. The device of claim 24, where depression of said second switch causes the speed sound created by said first switch to decrease in representation of speed.

26. The device of claim 22, further including a switch in said device which will sense predetermined rotation of said wheel and cause said microcontroller to emulate the sound of squealing tires, simulating a turning automobile or motorcycle at high speed.

27. The device of claim 21, where the device is in the form of a motorcycle handlebar having hand gripping portions at either end and at least one switch on said handlebar adjacent each gripping portion.

28. The device of claim 21, where the device is in the form of an aircraft control wheel.

* * * * *